US007926546B2

(12) United States Patent
Minamimura et al.

(10) Patent No.: US 7,926,546 B2
(45) Date of Patent: Apr. 19, 2011

(54) DEVICE FOR MELTING, STORING, AND FEEDING METAL MATERIAL FROM BAR-SHAPED METAL MATERIAL INTENDED FOR INJECTION APPARATUS FOR MOLDING METAL PRODUCT

(75) Inventors: Masaaki Minamimura, Hanishina-gun (JP); Yasuhiko Takeuchi, Hanishina-gun (JP); Toshiyasu Koda, Hanishina-gun (JP); Mamoru Miyagawa, Hanishina-gun (JP); Ikuo Uwadaira, Hanishina-gun (JP); Taku Kawano, Hanishina-gun (JP)

(73) Assignee: Nissei Plastic Industrial Co., Ltd., Hanishina-gun, Nagano-ken (JP)

( * ) Notice: Subject to any disclaimer, the term of this patent is extended or adjusted under 35 U.S.C. 154(b) by 325 days.

(21) Appl. No.: 12/354,239

(22) Filed: Jan. 15, 2009

(65) Prior Publication Data

US 2009/0178776 A1 Jul. 16, 2009

(30) Foreign Application Priority Data

Jan. 16, 2008 (JP) ..... 2008-007050

(51) Int. Cl.
*B22D 17/00* (2006.01)
*B22D 41/01* (2006.01)

(52) U.S. Cl. ..... 164/312; 266/236

(58) Field of Classification Search ..... 164/312, 164/113; 266/236

See application file for complete search history.

(56) References Cited

U.S. PATENT DOCUMENTS 7,284,592 B2 * 10/2007 Yamada ..... 164/312
7,331,372 B2 * 2/2008 Takizawa et al. ..... 164/113
7,858,017 B2 * 12/2010 Minamimura et al. ..... 266/45

FOREIGN PATENT DOCUMENTS

JP 2004291032 10/2004
JP 2005040807 2/2005
JP 2007160368 6/2007

* cited by examiner

*Primary Examiner* — Kevin P Kerns

(74) *Attorney, Agent, or Firm* — Weingarten, Schurgin, Gagnebin & Lebovici LLP

(57) ABSTRACT

A device for melting, storing, and feeding a metal material is provided which can store a large amount of molten metal material corresponding to molding cycles with a compact configuration, using barrels to melt bar-shaped metal materials and a tank-and-barrel storage unit to store the molten metal material. The storage unit for the molten metal material is composed of an upper storage tank and a lower material temperature control barrel having a smaller diameter, the barrel being perpendicularly arranged under and in communication with the bottom center of the tank. The melting barrels for bar-shaped metal materials are made of barrel bodies having an inside diameter and a length appropriate to accommodate the bar-shaped metal materials. A more than one melting barrel is vertically arranged in parallel on a lid member of the storage tank, with their bottom openings facing the inside of the storage tank.

6 Claims, 5 Drawing Sheets

DEVICE FOR MELTING, STORING, AND FEEDING METAL MATERIAL FROM BAR-SHAPED METAL MATERIAL INTENDED FOR INJECTION APPARATUS FOR MOLDING METAL PRODUCT

BACKGROUND OF THE INVENTION

1. Field of the Invention

The present invention relates to a device for melting, storing and feeding a metal material from a bar-shaped metal material intended for an injection apparatus for molding a metal product, in which bar-shaped metal materials such as magnesium and aluminum are melted and injected into a mold.

2. Description of the Related Art

Among conventional injection apparatuses for molding a metal product is one in which a melting furnace is installed on an injection cylinder having a plunger inside (Japanese Patent Application Laid-Open No. 2004-291032). A solid material is melted and stored in the melting furnace, and the plunger is retreated to create a material measuring chamber in the front part of the cylinder, into which the molten material is fed from the melting furnace and measured (accumulated) for a single shot of injection. The plunger is then advanced to inject the measured material into a mold from a nozzle at the top of the cylinder.

In another injection apparatus, the interior of an injection heating cylinder is used as a melt holding chamber (Japanese Patent Application Laid-Open No. 2005-40807). An injection plunger is retreated to create a material measuring chamber in front of the plunger, into which a molten material in the melt holding chamber is accumulated and measured for a single shot of injection. The injection plunger is then advanced to inject the single shot of measured material into a mold from a nozzle at the top of the injection heating cylinder. This injection apparatus has a melting device which includes: an insulated storage barrel erected on the melt holding chamber of the injection heating cylinder; and a melting barrel arranged sideways on the top side area of the insulated storage barrel. The melting barrel melts bar-shaped metal material, and the insulated storage barrel stores the molten metal material for a large number of shots. In yet another injection apparatus, the insulated storage barrel is made of a barrel having a constricted bottom, and a barrel for melting bar-shaped metal materials is erected on the top of the insulated storage barrel (Japanese Patent Application Laid-Open No. 2007-160368).

Take the case of the apparatus where a solid metal material is melted and stored in the melting furnace, and the molten metal material is measured for a single shot each time the plunger is retreated for injection. Here, the solid metal material is immersed and melted in the molten metal material that has been melted and stored in the furnace in advance. The melting is thus quick if there is some molten metal material in the melting furnace. When starting molding without molten metal material, however, the immersion melting will not occur and therefore it takes a long time before the bar shaped metal materials are melted up to an amount capable of immersion melting. In other words, the device for melting and storing a metal material using the melting furnace requires a long time for molding startup, with the problem of accordingly poor efficiency of the molding operation.

When melting a metal material in a melting furnace, the metal material in the furnace drops in temperature, i.e., causes temperature variations each time a new piece of metal material is loaded. The reason for this is that the loaded metal material, even if preheated, has a lower temperature than that of the molten metal material stored in the furnace. In order to avoid this loading-based temperature drop from affecting the molten metal material to be fed to the injection cylinder from the bottom of the melting furnace, the melting furnace must therefore be formed deep for the sake of an increased storage capacity. This inevitably makes the furnace body large in size and heavy in weight, producing the problem that the melting furnace can hardly be adopted for the device for melting and storing a metal material, to be installed on the injection cylinder.

Take the cases where bar-shaped metal materials are loaded into and melted in the melting barrel which has heating means on its periphery. This melting is effected by radiant heat which provides a melting rate lower than by the immersion melting, whereas the entire bar-shaped metal materials can be heated simultaneously from the periphery for high heating efficiency. The molten metal material flowing out of the melting barrel is stored into the insulated storage barrel of the injection heating cylinder or into a heating cylinder having an injection plunger inside, which precludes loading-based temperature variations. In addition, since a smaller amount of molten metal material needs to be stored for molding startup than with the melting furnace, the molding startup time can be reduced with the advantage of earlier start of the molding operation.

In the apparatuses where the molten metal material is stored in the storage unit outside the injection heating cylinder and is measured out for each single shot by retreating the injection plunger, the storage capacity is limited to that of the insulated storage barrel since the injection heating cylinder itself is not available for storing the metal material. The number of melting barrels that can be installed on the insulated storage barrel is also limited to one. Consequently, in terms of the relationship between the melting speed of the metal material and the molding cycles, it is sometimes difficult to melt and feed a sufficient amount of molten metal material corresponding to the molding cycles depending on the weight of metal products to be molded.

The insulated storage barrel may be increased in capacity and in size so as to store a larger amount of a molten metal material. This, however, makes the molten metal material to reside longer in the insulated storage barrel, so that temperature differences can occur easily from molten metal material that is newly supplied from the melting barrel. This is prevented by raising the temperature setting of the insulated storage barrel, which entails the problem of an inevitable increase in the thermal energy consumption.

SUMMARY OF THE INVENTION

The present invention has been achieved in order to solve the foregoing problems that are associated with the melting and storing of metal materials from bar-shaped metal materials in a melting furnace and the melting and storing of metal materials from bar-shaped metal materials by using a melting barrel. It is thus an object of the invention to provide a new device for melting, storing, and feeding metal materials from bar-shaped metal materials intended for an injection apparatus for molding a metal product, by which molten metal material is fed into an injection cylinder for each single shot of injection. This device shall use a barrel to melt the bar-shaped metal materials and a tank-and-barrel unit to store the molten metal material so that: it provides high melting efficiency even with a small size capable of installation on an injection cylinder; it can store a large amount of molten metal material corresponding to molding cycles even with the compact configuration; and it can preclude temperature variations of the molten metal material in the storage unit, and feed the injection cylinder with the molten metal material that is adjusted to a set temperature.

To achieve the foregoing object, the present invention provides a device for melting, storing and feeding a metal material from a bar-shaped metal material intended for an injection apparatus for molding a product, the device being arranged on an injection cylinder having an injection plunger inside, and feeding a molten metal material into the injection cylinder by one shot at a time.

The device for melting, storing, and feeing a metal material from a bar-shaped metal material includes a storage unit for molten material, including: an upper molten metal storage tank made of a cylindrical tank; a lower material temperature control barrel having a diameter smaller than an inside diameter of the storage tank, the material temperature control barrel being perpendicularly arranged under a bottom of the tank so as to communicate through an opening formed in a center of the bottom of the tank, a lower inner wall of the material temperature control barrel being gradually reduced in inside diameter to form a slope toward an outlet in a bottom center thereof, the outlet communicating with a feed opening formed in a top of the injection cylinder; a lid member fixed to an open top rim of the storage tank; and heating means arranged around peripheries of the storage tank and the material temperature control barrel, and a more than one melting barrel made of respective barrel bodies having an inside diameter and a length appropriate to accommodate a bar-shaped metal material, heating means being arranged around peripheries of the barrel bodies, the barrel bodies being vertically arranged in parallel on the lid member with bottom ends thereof inserted into a more than one hole formed in both side areas within the surface of the lid member so that bottom openings thereof are opened to inside the storage tank.

In the device for melting, storing, and feeding a metal material from a bar-shaped metal material according to the present invention, the storage unit includes the storage tank that has a height smaller than the length of the bar-shaped metal material, and the material temperature control barrel that has a height the same as or smaller than that of the storage tank and an outside diameter smaller than that of the injection cylinder. The storage unit is perpendicularly erected on the injection cylinder.

The lid member of the device for melting, storing, and feeding a metal material from a bar-shaped metal material is composed of a barrel body erection part at the center and a pair of swing door parts attached to both sides of the barrel body erection part, the swing door parts being pivotally supported along the longitudinal direction of the barrel body erection part.

The more than one melting barrel has a height capable of accommodating two pieces of bar-shaped metal material longitudinally stacked in series. The top ends of the more than one melting barrel is fixed to a support arm of a support column erected on a holding plate of the injection cylinder so that the device for melting, storing, and feeding a metal material from a bar-shaped metal material is supported perpendicularly.

According to the foregoing configuration, the melting of the bar-shaped metal material and the storing of the molten metal material are performed in the melting barrels and the storage unit separately, so that the storage unit is not involved in the melting of the bar-shaped metal material. This precludes the loading-based temperature variations of the molten metal material, which occur in the case of immersion melting in a furnace, thereby stabilizing the temperature of the molten metal material. The molten metal material can be stored in the storage unit which is composed of the tank and the barrel arranged under and in communication with the bottom center of the tank. This makes it possible to store and feed a large amount of molten metal material corresponding to the molding cycles, despite the use of the melting barrels for melting the metal material.

The more than one melting barrel is vertically arranged in parallel on the lid member of the upper storage tank which constitutes the device for melting, storing, and feeding, so that their bottom openings face the inside of the storage tank. This allows the molten metal material in the melting barrels to be let out and supplied into the storage tank below by gravitation with reliability all the time. The two melting barrels can also perform the melting operation simultaneously for reduced startup time. For alternate operations, either one of the melting barrels can make the melting operation while the other a preheating operation on standby. This improves the melting efficiency of the bar-shaped metal material, and stabilizes the feeding to the injection cylinder when combined with the increased amount of storage.

The tank and the barrel perpendicularly arranged under and in communication with the bottom center of the tank function as a material temperature control barrel for the molten metal material stored. The molten metal material flowing down from the storage tank into the barrel is then evened to the set temperature while residing in the control barrel. This makes it possible to feed the injection cylinder with the molten metal material of constant temperature by one shot for stable molding. Since the lid member of the storage tank has the swing door parts, these swing door parts can be opened to remove oxides and other impurities floating on the surface of the molten metal easily out of the tank by using cleaning tools.

Since the storage tank is not involved in the melting of the bar-shaped metal material, the storage unit composed of the tank and the barrel has only to have a capacity sufficient to store molten metal material as much as the more than one melting barrel produces at a time. The height of the storage tank therefore need not be determined to cover the length of the bar-shaped metal material. Besides, the material temperature control barrel has only to have a storage capacity capable of material temperature control corresponding to the molding cycles. This allows a low-height compact configuration which facilitates installation on the injection cylinder.

DETAILED DESCRIPTION OF THE PREFERRED EMBODIMENTS

Figure 1:
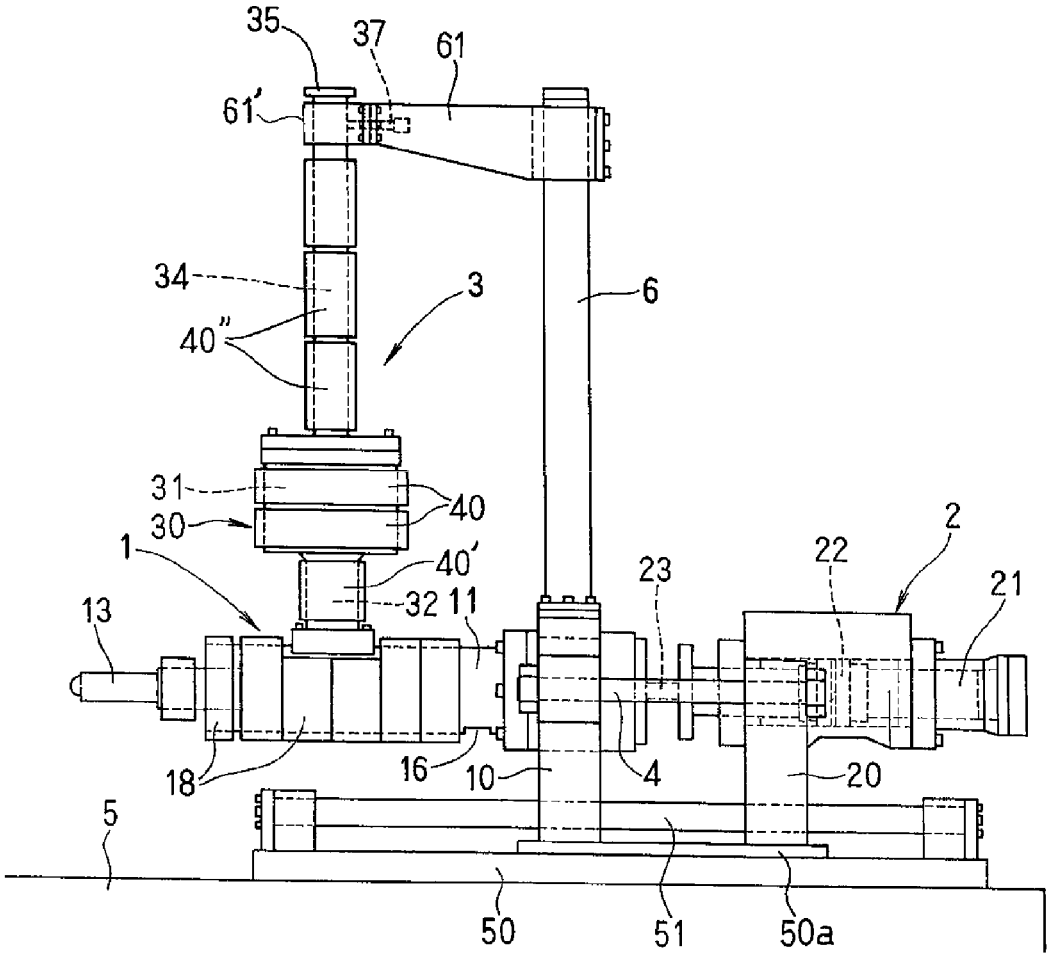
FIG. 1 is a side view of an injection apparatus for molding a metal product, including a device for melting, storing, and feeding a metal material according to the present invention.
Figure 2:
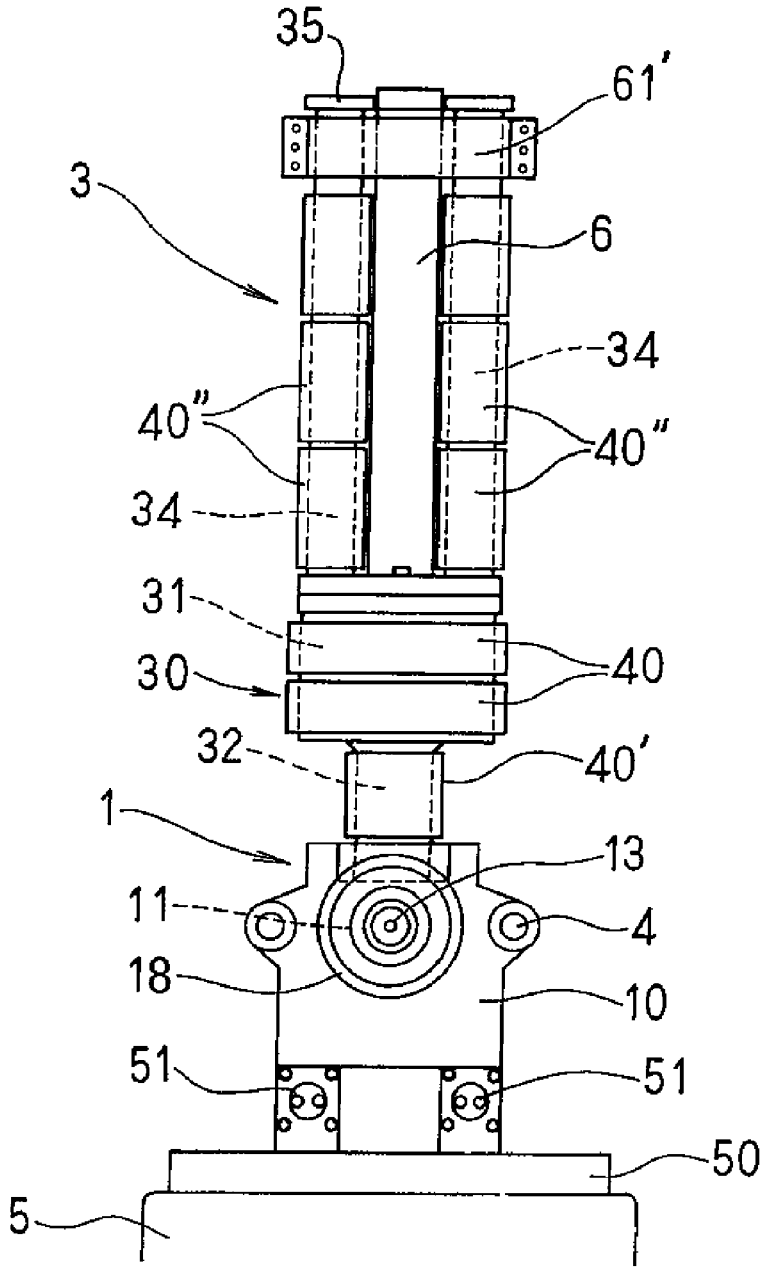
FIG. 2 is a front view of the same.
Figure 3:
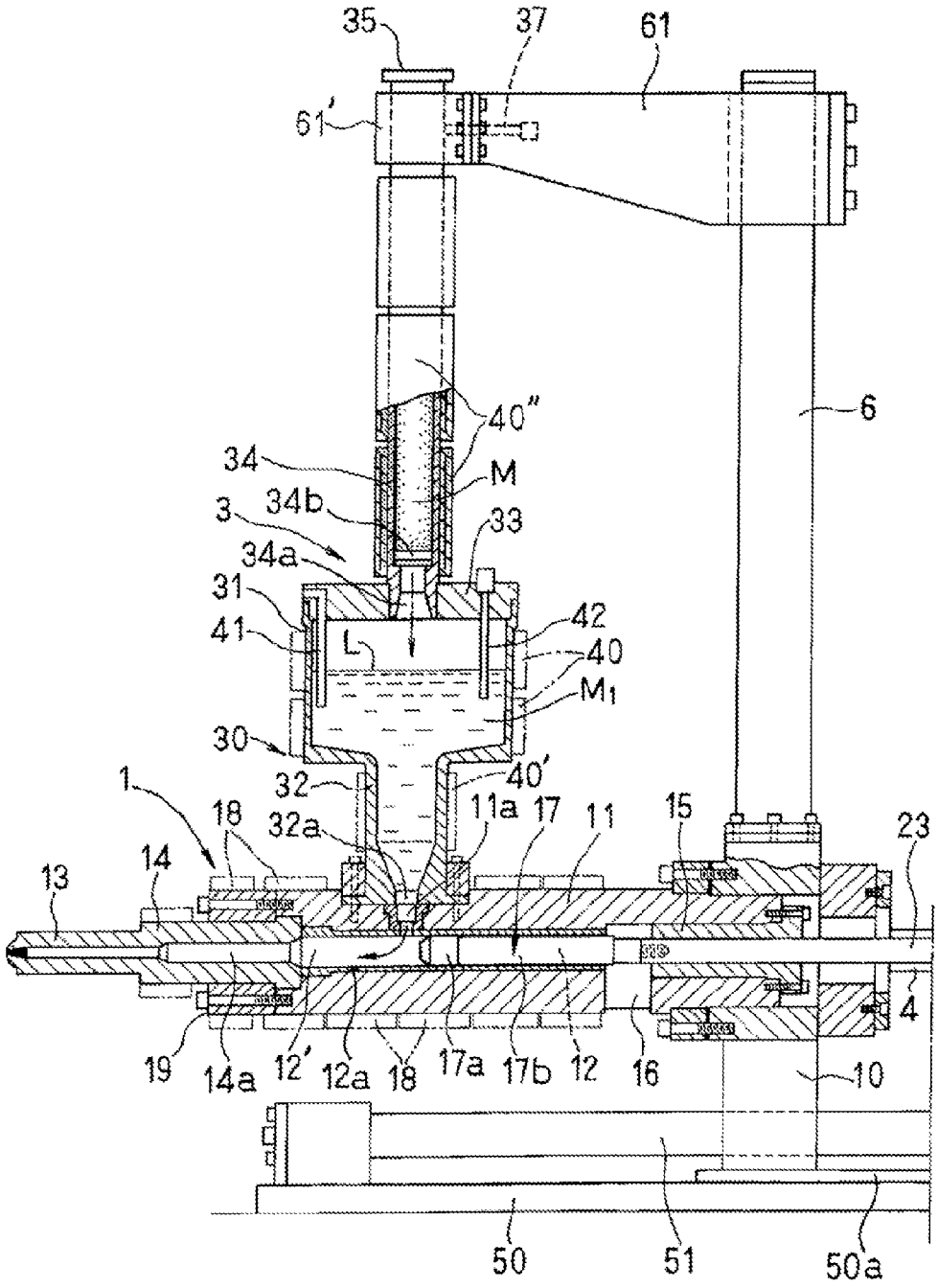
FIG. 3 is a longitudinal sectional side view of the injection apparatus and the device for melting, storing, and feeding a metal material.

In the accompanying drawings, the reference numeral 1 designates an injection cylinder, and 2 an injection drive unit which is placed at a distance from the rear end of the injection cylinder 1. The two units are coupled with rods 4 on both sides, and are movably arranged on a base 5. The reference numeral 3 designates a device for melting, storing, and feeding a metal material, which is arranged on a cylinder body 11 of the injection cylinder 1 so as to communicate with the inside of the same.

The injection cylinder 1 is horizontally installed with the rear end of the cylinder body 11 inserted and fixed to a holding plate 10 on the base 5. The holding plate 10 is pierced with a pair of right and left support shafts 51 arranged in parallel on a seat plate 50 of the base 5, and is fixed at its bottom to a slide plate 50*a* on the seat plate 50 so that it can reciprocate freely with the cylinder body 11. A support column 6 intended for the device 3 for melting, storing, and feeding a metal material is erected on the holding plate 10. This support column 6 is a cylindrical column to which a support arm 61 is attached along the direction of the cylinder. The top ends of melting barrels 34 of the device 3 for melting, storing, and feeding a metal material to be described later are firmly held by a pair of front and rear joint plates 61' at the arm end, whereby the device 3 for melting, storing, and feeding a metal material is perpendicularly supported on the cylinder body 11.

The cylinder body 11 has a cylinder hole part 12 and an outlet hole 16. The cylinder hole part 12 is formed by a cylinder liner 12*a* which is in contact with the inner surface of the cylinder. The outlet hole 16 is formed in the bottom wall of the cylinder, between the rear end of the cylinder liner 12*a* and a bushing 15 lying in the rear end part of the cylinder body 11. An injection plunger 17 is inserted into the cylinder hole part 12 through the bushing 15 at the rear end of the body. The injection plunger 17 is formed by attaching a plunger head 17*a* having a truncated cone top to the end of a plunger rod 17*b*. Band heaters, or heating means 18, are arranged around the periphery of the cylinder. A nozzle member 14 integrated with a nozzle 13 is attached to the front end of the body.

The nozzle member 14 is a cylindrical body having the nozzle 13 at the top. A flow channel 14*a* communicating with the nozzle opening is formed inside. The nozzle member 14 is attached to the front end of the cylinder body 11 by means of bolts and a coupling ring 19 which is fitted to around the cylindrical body. The flow channel 14*a* has a diameter smaller than the inside diameter of the cylinder hole part 12. The open end opposite from the nozzle opening is formed to increase in diameter up to the same diameter as that of the cylinder hole part 12, with a shape conforming to the top surface of the plunger head 17*a*.

The injection drive unit 2 is composed of a hydraulic cylinder 21, a piston 22 in the cylinder, and an injection rod 23. The hydraulic cylinder 21 has a support leg 20 under its front end. The injection rod 23 is attached to the rod end of the piston 22. The extremity of the injection rod 23 is coupled to the rear end of the plunger rod 17*b*. Like the holding plate 10, the support leg 20 is pierced with the pair of right and left support shafts 51 arranged in parallel on the seat plate 50 of the base 5, and is fixed at the bottom to the slide plate 50*a* on the seat plate so that it can reciprocate freely with the injection cylinder 1.

The device 3 for melting, storing, and feeding a metal material includes a storage unit 30 and a pair of melting barrels 34 of predetermined height. The storage unit 30 stores a metal material in a molten state (for example, molten metal) and keeps its temperature. The melting barrels 34 are arranged on the storage unit 30, with the top ends firmly held by the support arm 61 of the support column 6. The storage unit 30 is composed of an upper storage tank 31, a lower material temperature control barrel 32, and a lid member 33 of the storage tank 31. The storage tank 31 is made of a cylindrical tank. The material temperature control barrel 32 is a cylindrical body having a diameter smaller than those of the storage tank 31 and the cylinder body 11, and is perpendicularly arranged under and in connection with the center of the tank bottom. A mounting flange is integrally formed around the bottom end of the material temperature control barrel 32. The lid member 33 is attached to the rim of the storage tank 31 by means of not-shown bolts. The material temperature control barrel 32 preferably has an outside diameter in the range of 35% to 45% the outside diameter of the storage tank 31. Below the range, the reduced storage capacity makes it difficult to perform a material temperature control depending on the molding cycles.

A gas injection pipe 41 intended for an inert gas, a flame retardant gas, or the like is inserted into the top of the storage tank 31. A level detection bar 42 is installed inside the storage tank 31 through the lid member 33. The lower inner wall of the material temperature control barrel 32 is gradually reduced in diameter to form a slope toward an outlet 32*a* in the bottom center. The outlet 32*a* is formed with a diameter greater than that of a feed opening 11*a* which is formed in the cylinder body 11. This storage unit 30 is perpendicularly erected on the injection cylinder 1, with the material temperature control barrel 32 placed on the cylinder. The flange is fastened to the cylinder by means of bolts so that the outlet 32*a* is directly connected to the feed opening 11*a* which is formed by a sleeve.

The melting barrels 34 may each be made of a barrel body that has a length sufficient to accommodate two bars of metal material having a circular cross section (hereinafter, referred to as metal round bar materials M) as longitudinally stacked in series. For example, magnesium-based alloys have a conventional size of 300 mm in length and 60 mm in diameter. With some extra length, the melting barrels 34 may thus be formed as cylindrical bodies of 850 mm in length and 62 mm in inside diameter. The cylindrical bodies are then vertically arranged in parallel on the lid member 33 of the storage unit 30 with their bottom ends inserted into holes that are formed in both side areas within the surface of the lid member 30, so that the bottom openings 34*a* face the inside of the storage tank 31.

The melting barrels 34 have an outlet hole in the bottom, with a diameter smaller than the inside diameter of the barrel bodies. The lower portions of these outlet holes are increased in diameter up to the lower rims of the bottom openings 34*a*. The outlet holes have a stepped top. Material support rods 34*b* are laid across inside the barrel bodies above the steps, so that the metal round bar materials M load from the top of the barrels can be retained inside the barrel bodies and melted by radiant heat from around. The molten metal material can thus be let out directly from the bottom openings 34*a* by gravitation and stored into the storage unit 30 as molten metal material $M_1$.

The top openings of the melting barrels 34 are closed with detachable lids 35. Gas inlets 36 are formed in the upper walls of the melting barrels 34. These gas inlets 36 are connected to injection pipes 37 intended for an inert gas or flame retardant gas. This makes it possible to melt the metal round bar materials M in an inert gas or flame retardant gas atmosphere even in the melting barrels 34.

Heating means 40, 40', and 40" are arranged around the peripheries of the storage tank 31, the material temperature control barrel 32, and around the peripheries of the melting barrels 34. The heating means are composed of band heaters arranged in a plurality of separate stages. The heating means are configured so that temperature control can be performed heater by heater. When melting a metal material (for example, magnesium-based alloy AZ91D) completely (into molten metal), the heater temperature is set at or above the liquidus temperature (600° C. or higher). For semi-molten state (solid-liquid coexisting state), the heater temperature is set to below the liquidus temperature and above the solidus temperature (570° C. to 585° C.).

The melting of the metal round bar materials M is performed in the melting barrels 34 alone. The storage tank 31 and the material temperature control barrel 32 of the storage unit 30 are not involved in the melting of the metal materials. Then, the heating means 40 and 40' on their peripheries primarily function to maintain and control the temperature of the molten metal material $M_1$, except when melting residual metal material at the start of molding. Having a smaller diameter than that of the storage tank 31, the material temperature control barrel 32 has higher efficiency than the storage tank 31 when heating the molten metal material inside. This reduces the time necessary for material temperature control, so that the temperature distribution can be adjusted before the material is fed to the injection cylinder 1.

Figure 5:
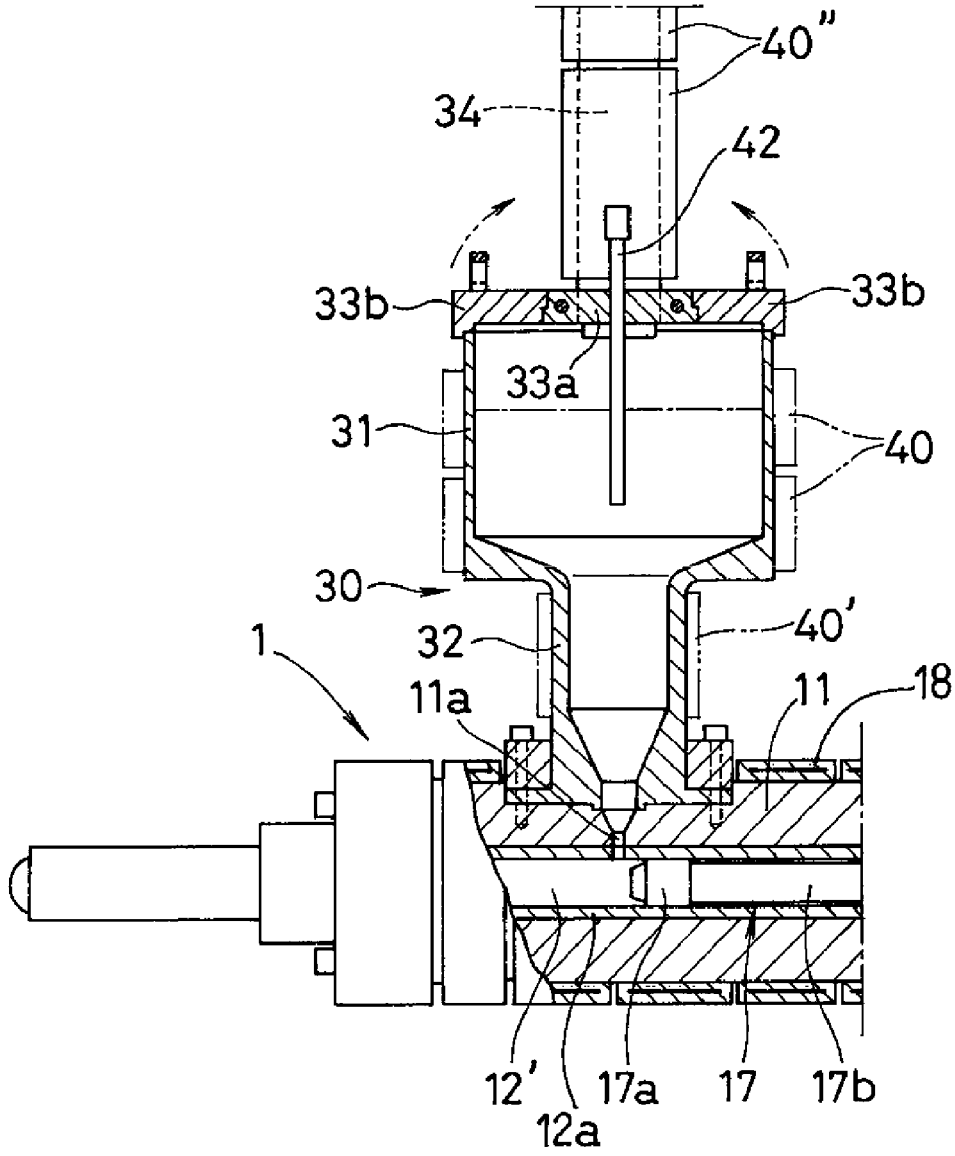
FIG. 5 is a longitudinal sectional side view of the device for melting, storing, and feeding a metal material according to another embodiment.

FIG. 5 shows a device 3 for melting, storing, and feeding a metal material according to another embodiment. In this instance, the lid member 33 of the storage unit 30 is composed of a barrel body erection part 33*a* at the center and a pair of front and rear swing door parts 33*b*. The swing door parts 33*b* are attached to both sides of the barrel body erection part 33*a*, being pivotally supported along the longitudinal direction of the erection part. The swing door parts 33*b* can be opened upward so that a sludge removing operation and a tank cleaning operation can be performed by using cleaning tools. The bottom center of the material temperature control barrel 32 is fitted to the sleeve of the cylinder body 11. The bottom inner wall of the material temperature control barrel 32 is sloped to decrease in inside diameter until it reaches the feed opening 11*a* in the sleeve, so that the molten material stored can flow into the cylinder hole 12 more smoothly.

In either of the foregoing embodiments, the device 3 for melting, storing, and feeding a metal material of the foregoing configuration requires no valve for opening and closing the bottom end of the material temperature control barrel 32. The reason for this is that the injection plunger 17 functions as the valve for opening and closing the feed opening 11*a*. The amount of molten metal material $M_1$ let into the cylinder is limited to as much as a single shot of injection even when the injection plunger 17 is retreated to the position where the plunger head 17*a* lies behind the feed opening 11*a*.

The melting barrels 34 can melt the metal round bar materials M with high efficiency since the cylindrical bodies and the peripheries of the metal materials have only a small gap therebetween, and the entire peripheries of the metal materials are heated by radiant heat from the barrel walls. Even at the start of molding, the melting by the two melting barrels 34 (approximately 20 minutes) is faster than when the same four metal round bar materials are put into an empty melting furnace and melted together (approximately 60 minutes). The molten metal material $M_1$ can thus be accumulated up to the set melt level L more quickly, with a reduction in the molding startup time.

Figure 4:
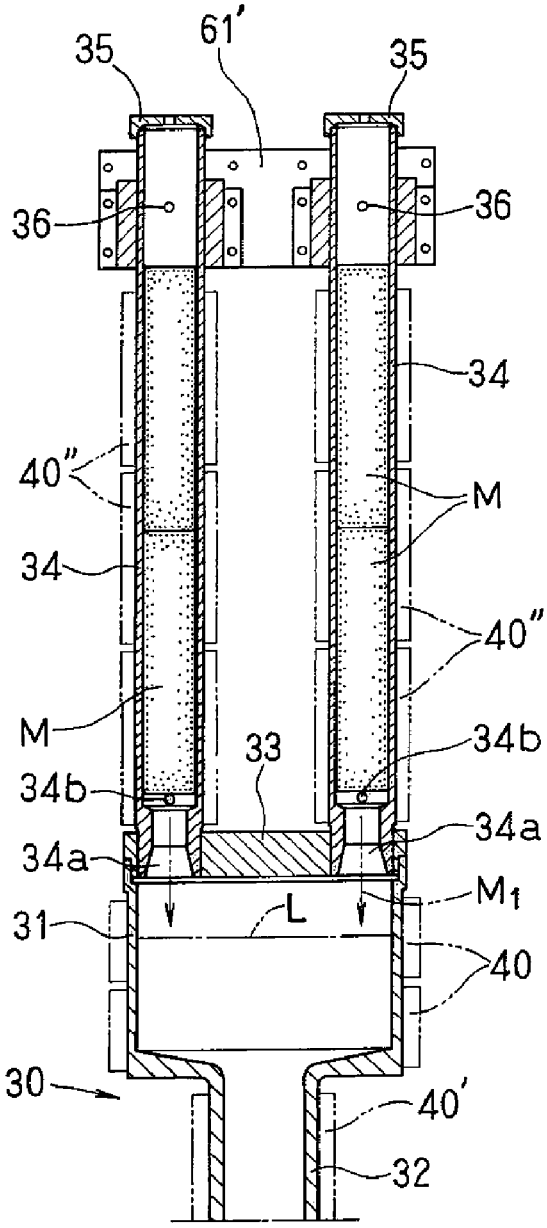
FIGS. 4A and 4B are longitudinal sectional front views of the device for melting, storing, and feeding a metal material, FIG. 4A being an explanatory diagram for the case where metal round bar materials are melted in both melting barrels, FIG. 4B being an explanatory diagram for the case where metal round bar materials are melted in either one of the melting barrels.
Figure 4:
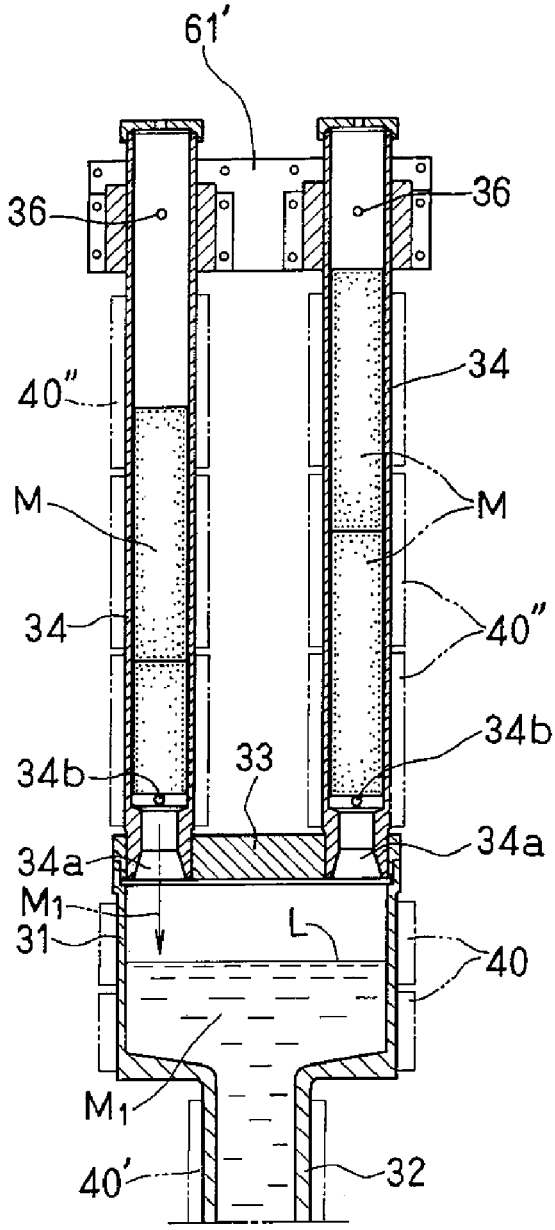

FIGS. 4A and 4B show the melting operation of the two melting barrels 34. FIG. 4A shows the case where both the melting barrels 34 perform the melting operation simultaneously, thereby accumulating the molten metal material $M_1$ up to the set level L, such as when starting molding.

FIG. 4B shows the case where the melting operation is performed by either one of the melting barrels 34 at a time after the set level L is reached by the molten metal material $M_1$ stored. While one of the melting barrels is making the melting operation, the other is temperature controlled to preheat the metal round bar materials M. After the one finishes the melting operation and the amount of molten metal material $M_1$ stored falls below the set level L, the other is switched from preheating to melt heating, thereby entering the operation to melt the metal round bar materials M. The empty barrel is reloaded with metal round bar materials M, and is switched to the preheating operation on the metal round bar materials M. This alternate operation of the two melting barrels 34 between preheating and melting makes it possible to supply a set amount of molten metal material $M_1$ to the storage unit 30 continuously, and store the molten metal material $M_1$ in the storage tank 31 and the material temperature control barrel 32 smoothly.

In the device 3 for melting, storing, and feeding a metal material of the foregoing configuration, an inert gas such as argon gas and nitrogen gas or a flame retardant gas such as $SF_6$ can be injected into both the storage unit 30 and the melting barrels 34 so that the metal round bar materials M can be melted and the molten metal material $M_1$ can be stored in the gas atmosphere. Here, the metal round bar materials M are loaded into the melting barrels 34 through the openings in the top ends of the barrels, and the top openings are closed with perforated lids before melting.

To feed the molten metal material $M_1$ from the storage unit 30 to the injection cylinder 1, the top of the nozzle 13 is brought into touch with a mold. This nozzle touch cools the nozzle top and the material remaining in the nozzle top together, whereby the remaining material is solidified into a metal plug. The injection drive unit 2 then makes a contracting operation, whereby the injection plunger 17 at the advanced position is retreated to the position where the plunger head 17*a* lies behind the feed opening 11*a*.

By this retreat, the cylinder interior in front of the plunger head 17*a* functions as a material measuring chamber 12' for the molten metal material that flows out of the feed opening 11*a* opened. Consequently, the molten metal material (not shown) is accumulated (measured out) in front of the plunger head 17*a* as much as a single shot of injection. When the injection drive unit 2 makes an extending operation, the injection plunger 17 advances to pressurize the measured single shot of molten metal material with the plunger head 17*a*. This pushes out the metal plug into a pocket at the sprue top of the not-shown mold, and then the molten metal material is injected and filled into the mold through the nozzle 13 until the injection plunger 17 stops at the advanced position.

The device 3 for melting, storing, and feeding a metal material melts the metal round bar materials M and stores the molten metal material $M_1$ in the melting barrels 34 and in the storage unit 30 separately. Since the storage tank 31 at the top of the storage unit 30 is not involved in the thermal melting of the metal round bar materials M, the storage unit 30 has only to have a depth sufficient to store molten metal material as much as the two melting barrels 34 produce from four bars at a time. The height of the storage tank 31 therefore need not be determined to cover the length of the metal round bar materials M, and may be even smaller than the length of the metal round bar materials M.

The material temperature control barrel 32 has only to have a storage capacity such that the molten metal material inside can be adjusted to uniform temperature before fed into the injection cylinder (for example, as much as 15 to 20 shots). The material temperature control barrel 32 may therefore have the same height as that of the storage tank 31 or even smaller, depending on the outside diameter. In consequence, the storage unit 30 is reduced in height and miniaturized in size.

For example, if the storage unit 30 has a storage tank 31 of 285 mm in tank height and 320 mm in tank outside diameter, and a material temperature control barrel 32 of 180 mm in barrel height and 120 mm in barrel outside diameter, with a total height of 465 mm excluding the melting barrels 34, then it can store 10 kg of molten metal material at the maximum. This storage unit 30 can melt, store, and feed the metal material corresponding to the molding cycles when installed on an injection cylinder 1 of 190 mm in cylinder outside diameter.

What is claimed is:

1. A device for melting, storing, and feeding a metal material from a bar-shaped metal material intended for an injection apparatus for molding a metal product, the device being arranged on an injection cylinder having an injection plunger inside, and feeding a molten metal material into the injection cylinder one shot at a time, the device comprising:

a storage unit for the molten metal material, including:

an upper molten metal cylindrical storage tank;

a lower material temperature control barrel having a diameter smaller than an inside diameter of the cylindrical storage tank;

the material temperature control barrel being perpendicularly arranged under a bottom of the storage tank so as to communicate through an opening formed in a center of the bottom of the storage tank;

a lower inner wall of the material temperature control barrel being gradually reduced in inside diameter narrowing toward an outlet in a bottom center thereof;

the outlet communicating with a feed opening formed in a top of the injection cylinder;

a lid member fixed to an open top rim of the storage tank;

and heating means arranged around peripheries of the storage tank and the material temperature control barrel, and a plurality of melting barrels having respective barrel bodies having an inside diameter and a length appropriate to accommodate the bar-shaped metal material;

heating means being arranged around peripheries of the barrel bodies, the barrel bodies being vertically arranged in parallel on the lid member with bottom ends thereof inserted into a corresponding plurality of holes formed in both side areas within a surface of the lid member so that bottom openings thereof open into the storage tank.

2. The device according to claim 1, wherein the storage unit comprises the storage tank that has a height smaller than the length of the bar-shaped metal material, and the material temperature control barrel that has a height the same as or smaller than that of the storage tank and an outside diameter smaller than that of the injection cylinder, and wherein the storage unit is perpendicularly erected on the injection cylinder.

3. The device according to claim 1, wherein the material temperature control barrel has an outside diameter in a range of 35% to 45% an outside diameter of the storage tank.

4. The device according to claim 1, wherein the heating means arranged around the peripheries of the storage tank and the material temperature control barrel and around the peripheries of the melting barrels is a plurality of sections of band heaters, and is capable of temperature control section by section.

5. The device according to claim 1, wherein the lid member is composed of a barrel body erection part at the center and a pair of swing door parts attached to both sides of the barrel body erection part, the swing door parts being pivotally supported along a longitudinal direction of the barrel body erection part.

6. The device according to claim 1, wherein the more than one melting barrel has a height capable of accommodating two pieces of the bar-shaped metal material longitudinally stacked in series, and wherein respective top ends of the melting barrels are fixed to a support arm of a support column erected on a holding plate of the injection cylinder so that the device is supported perpendicularly.

* * * * *